US006098357A

United States Patent [19]

Franklin et al.

[11] Patent Number: 6,098,357

[45] **Date of Patent: *Aug. 8, 2000**

[54] MODULAR PRECAST CONSTRUCTION BLOCK SYSTEM

[75] Inventors: Howard M. Franklin; Erik Garfinkel, both of Palo Alto, Calif.

[73] Assignee: Megawall Corporation, Las Vegas, Nev.

[ * ] Notice: This patent is subject to a terminal disclaimer.

[21] Appl. No.: 08/758,973

[22] Filed: Dec. 2, 1996

Related U.S. Application Data

[63] Continuation of application No. 08/335,059, Nov. 7, 1994, abandoned.

[51] Int. Cl.[7] ..... E04B 1/06; E04B 2/18; E04B 2/26

[52] U.S. Cl. ..... 52/223.7; 52/293.2; 52/295; 52/439; 52/592.6

[58] Field of Search ..... 52/293.2, 295, 52/439, 503, 504, 223.7, 566, 567, 592.6, 606, 607, 506.05; 182/55, 57

[56] References Cited

U.S. PATENT DOCUMENTS

| | | | |
|---|---|---|---|
| 1,412,113 | 4/1922 | Hermoye et al. | 52/606 |
| 1,704,255 | 3/1929 | Lewis | 52/295 |
| 1,783,383 | 12/1930 | Montrief | 52/223.7 |
| 2,008,775 | 7/1935 | Staman | 52/506.05 |
| 3,106,751 | 10/1963 | Fish | 52/506.05 |
| 3,286,418 | 11/1966 | Radford | 52/606 |
| 3,416,272 | 12/1968 | Gue | 52/606 |
| 3,435,567 | 4/1969 | Tyson | 52/503 |
| 3,950,902 | 4/1976 | Stout | 52/295 |
| 4,124,963 | 11/1978 | Higuchi . | |
| 4,328,651 | 5/1982 | Gutierrez . | |
| 4,475,626 | 10/1984 | Gleich | 182/55 |
| 4,583,336 | 4/1986 | Shelangoskie et al. . | |
| 4,726,567 | 2/1988 | Greenberg | 52/293.2 |
| 4,787,189 | 11/1988 | Haug et al. | 52/606 |
| 5,081,805 | 1/1992 | Jazzar . | |
| 5,103,613 | 4/1992 | Kinoshita . | |
| 5,138,808 | 8/1992 | Bengtson et al. | 52/295 |

OTHER PUBLICATIONS

Sheppard, David A. and William R. Phillips, *Plant–Cast Precast & Prestressed Concrete, Third Edition*, pp. 311–312, 340–341, McGraw–Hill Inc., 1989.

*Primary Examiner*—Michael Safavi
*Attorney, Agent, or Firm*—Hickman, Stephens, Coleman & Hughes, LLP

[57] ABSTRACT

A modular precast construction block system (10) with a wall subsystem (12) and a foundation subsystem (14). The wall subsystem (12) has a number of wall units (16) having cavities (40) and prestressed tension cables (58) cast therein. The wall units (16) are vertically stacked with alignment channels (42) in the top surface (28) of one wall unit (16) receiving the key portion in the bottom surface (30) of the wall unit (16) above, to form walls (26) with vertically aligned cavities (40). Threaded wall bars (24) and extension bars (74) are threaded through the cavities with a wall tensioning assembly (22) applying downward force on the wall units (16) and providing structural strength to the wall. The foundation subsystem (14) includes a variety of precast foundation members including T footing members (126), pier members (128), grade beam members (130), and column members (132). The T footing members (126) and grade beam members (130) include complementary angled pairs for creating angled and "T" joint foundation designs.

18 Claims, 8 Drawing Sheets

MODULAR PRECAST CONSTRUCTION BLOCK SYSTEM

This application is a continuation of application Ser. No. 08/335,059 filed on Nov. 7, 1994 abandoned.

TECHNICAL FIELD

The present invention relates generally to the field of construction, and more particularly to construction systems implementing interconnecting precast forms to create buildings and other structures.

BACKGROUND ART

Shelter is a basic need, and human ingenuity has arrived at numerous sophisticated methods and materials to meets this need. Among the many methods are those using precast concrete units that are assembled to create a structure. These methods include construction systems incorporating a wide range of precast unit design, from the simple design to the very complex. The most simple precast unit designs are those used in basic, concrete masonry. While concrete masonry units are easy to design, they can result in structures that are considered structurally inferior to those created with larger, reinforced concrete units. Smaller concrete masonry units can crack and chip as well. Working with small masonry units also requires a specialized labor force to implement. As a result, using such a building method can create high labor costs, and it can be difficult to find a qualified crew.

More sophisticated construction systems use concrete columns, beams, and foundation member to create a superstructure. A beam and column joining assembly is set forth in U.S. Pat. No. 4,583,336, issued to Shelangoskie et al. on Apr. 22, 1986. A series of precast foundation elements are also present in the prior art. U.S. Pat. No. 5,103,613 issued to Satoru Kinoshita on Apr. 14, 1992 teaches foundation members interconnected by a binding member having mortises therein for receiving tenons on the bottom of a column. U.S. Pat. No. 4,124,963 issued to Tadayasu Higuchi on Nov. 14, 1978 sets forth a precast unit for providing footing for a building. While the above patents describe a superstructure they provide no teachings on the construction of walls or the like. In addition, the precast units provide little flexibility in increasing structural integrity.

Two U.S. patents present precast units containing wall members. U.S. Pat. No. 4,328,651 issued to Manuel Gutierrez dated May 11, 1982 presents a system having a number of precast units including footing boxes, grade beams, roof beams and a wall panel. The Gutierrez system sets forth an intricate system of interconnecting parts. The intricacies of design limit the flexibility of the system, however. The beams and wall panels would have to be formed to custom lengths and height in order to meet the needs of varying structures. In addition, the wall panels lack flexibility in increasing structural strength. The second patent is U.S. Pat. No. 5,081,805 issued to M. Omar A. Jazzar on Jan. 21, 1992. This patent teaches precast units of half story height that include steel reinforcements. The Jazzar invention requires substantial lifting equipment, however, and is also limited in versatility. Building designs departing from the preformed dimensions require a second, expensive mold, or considerable custom work to arrive at the desired shape.

Authors David A. Sheppard and William R. Phillips illustrate unitary load-bearing or non-load-bearing precast panels in their book *Plant-Cast Precast & Prestressed Concrete—A Design Guide,* Third Edition, McGraw-Hill Inc., 1989, (see pages 311–13). The same book also illustrates the use of very large, precast, concrete "voided" bearing walls on page 340. The large bearing walls and precast panels, like those in the Gutierrez patent, must be custom formed, requiring large custom molds, a large site slab, and very large lifting equipment. In addition, the immense size of the walls makes them impractical for smaller construction projects.

To the inventors' knowledge, no building system employing preformed members has been developed that provides versatility in design, can accommodate a variety of reinforcement designs, requires relatively small lifting equipment, and that provides for the rapid construction of buildings.

DISCLOSURE OF INVENTION

Accordingly, it is an object of the present invention to provide a construction system using preformed members that can be used to design a variety of building shapes.

It is another object of the present invention to provide construction system using preformed members that can accommodate a wide range of reinforcement designs.

It is still another object of the present invention to provide a construction system using preformed members that can rapidly construct buildings.

It yet another object of the present invention to provide a construction system using preformed members that does not require a large amount of specialized erection equipment.

It is still another object of the present invention to provide a construction system using preformed members that does not require a crew having specialized skills.

It is yet another object of the present invention to provide a construction system using preformed members that includes built-in alignment aids.

Still another object of the present invention is to provide a construction system using preformed members that is cost effective for residential and light-commercial projects.

It is another object of the present invention to provide a construction system using preformed members with wall units that can be easily cut to size.

Briefly, the preferred embodiment of the present invention is a modular precast horizontal construction block system including a foundation subsystem and a wall subsystem. The wall subsystem of the preferred embodiment includes precast, vertically stackable wall units, each having a number of vertical cavities. Once the wall units are stacked, the cavities can receive reinforcing grout, vertical reinforcement bars, or a combination of both. A shear tying assembly is provided for connecting horizontally adjacent wall units. Also included is a reinforcement bar extension assembly for increasing the vertical height of reinforcement bars, and a wall tensioning assembly for increasing the structural integrity of a wall created with the wall units and reinforcement bars.

In the preferred embodiment, the wall units are designed to be stacked onto wall bars that extend upward from a foundation. Each wall unit is a generally rectangular solid with a number of vertical disposed in a row along the length of the wall unit. The wall units can be stacked with the reinforcement wall bars extending through the vertical cavities. If the wall bar is not of sufficient height, the reinforcement bar extension assembly can connect an extension bar to the end of a wall bar to extend the reinforcement bar structure. To increase wall stability and assist in the aligning the wall units, in the preferred embodiment, the bottom surface of each wall unit includes a downward extending key portions. Correspondingly, the top surface of each wall unit includes a channel of complementary shape to the key portion. The channel-key arrangement enables the wall units to be vertically aligned with one another when stacked. Grout is added to selected cavities to increase structural strength., if desired.

In the preferred embodiment, a unique scaffolding assembly is provided that is particularly adapted to mate with, and be deployed along walls created with the wall units.

The foundation subsystem of the preferred embodiment provides precast "T" spread footing type components, precast grade beam components, precast pier components, and precast vertical columns. In the preferred embodiment, the "T" footing components are shaped at a variety of angles that enable the "T" footing components to be joined together to create a variety of angled corners and tee joints. The "T" footing components are further designed to overlap onto one another by one "T" footing component providing an overlap portion, and a second component providing a ledge portion. The grade beam components are similar in design to the T footing components, being angled so as to be capable of forming a variety of angled connections. The grade beam components each include a number of vertical holes for receiving reinforcing bars provided by conventional cast-in-place foundations, or precast components of the present invention. The pier components are provided for concentrated load points in a foundation, and the column components provide for raised vertical load points. All the precast components of the foundation subsystem can be cast with vertical wall bars set therein.

An advantage of the present invention is that it provides a construction system using preformed members wherein the preformed members may be stockpiled and cut and used as needed.

A further advantage of the present invention is that it provides a construction system using preformed members that are quickly and easily assembled to create structures.

Yet another advantage of the present invention is that it provides a construction system using preformed members of consistent, accurate dimensions.

Still another advantage of the present invention is that it provides a construction system using preformed members that can be deployed in inclement weather.

Yet another advantage of the present invention is that it provides a construction system using preformed members that include stock sizes that can cover a wide range of load requirements.

Still another advantage of the present invention is that it provides a construction system using preformed members that can erect structures using smaller crews.

Another advantage of the present invention is that it provides a construction system using an easily deployed, custom scaffold assembly.

Yet another advantage of the present invention is that is provides a construction system using preformed member that generates very little debris.

Still another advantage of the present invention is that it provides a construction system using preformed members that does not require a superstructure.

These and other objects and advantages of the present invention will become clear to those skilled in the art in view of the description of the best presently known mode of carrying out the invention and the industrial applicability of the preferred embodiment as described herein and as illustrated in the several figures of the drawing.

BEST MODE FOR CARRYING OUT INVENTION

Figure 1:
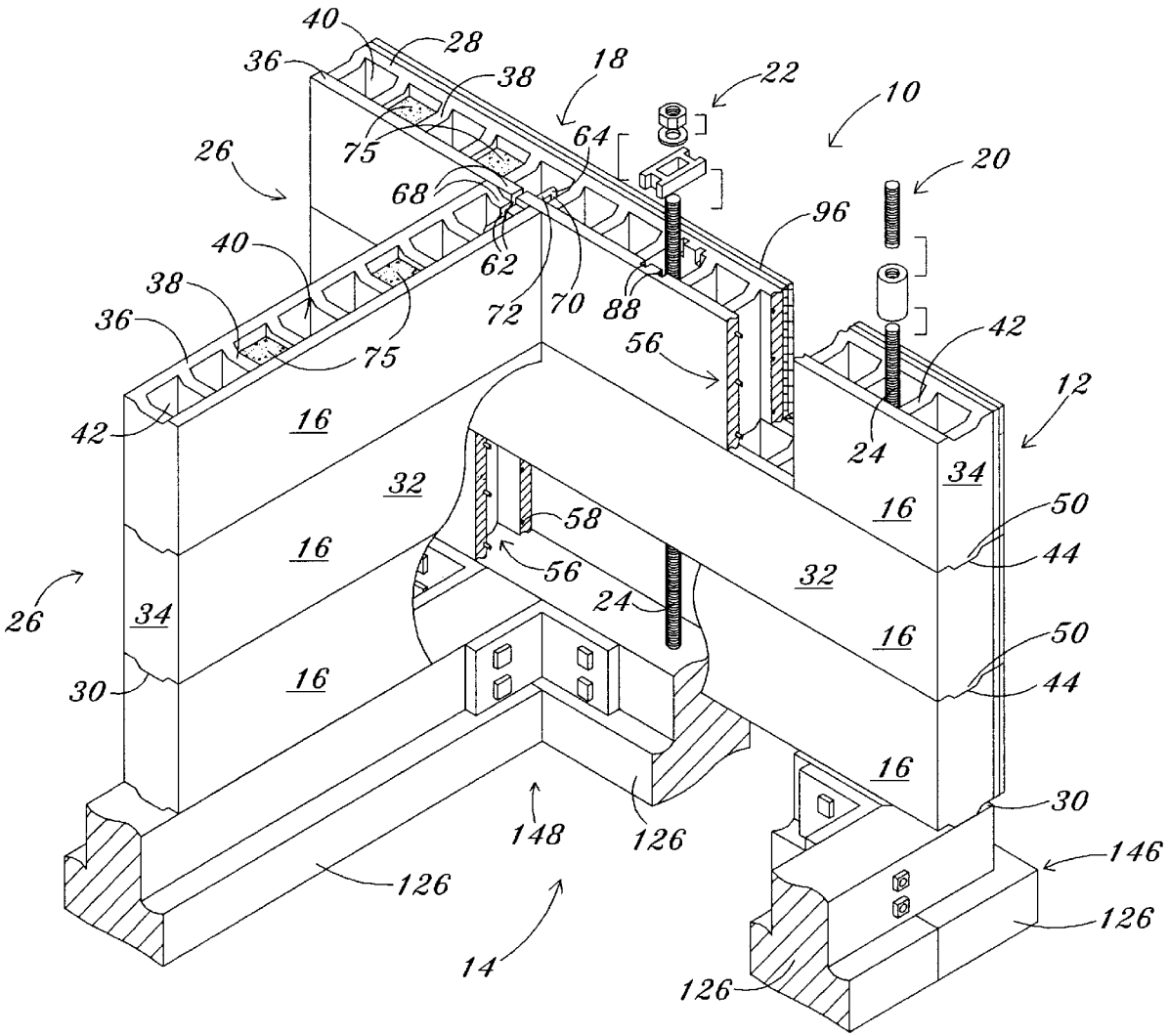
FIG. 1 is a fanciful isometric, cut away view of the preferred embodiment of the present invention.
Figure 2:
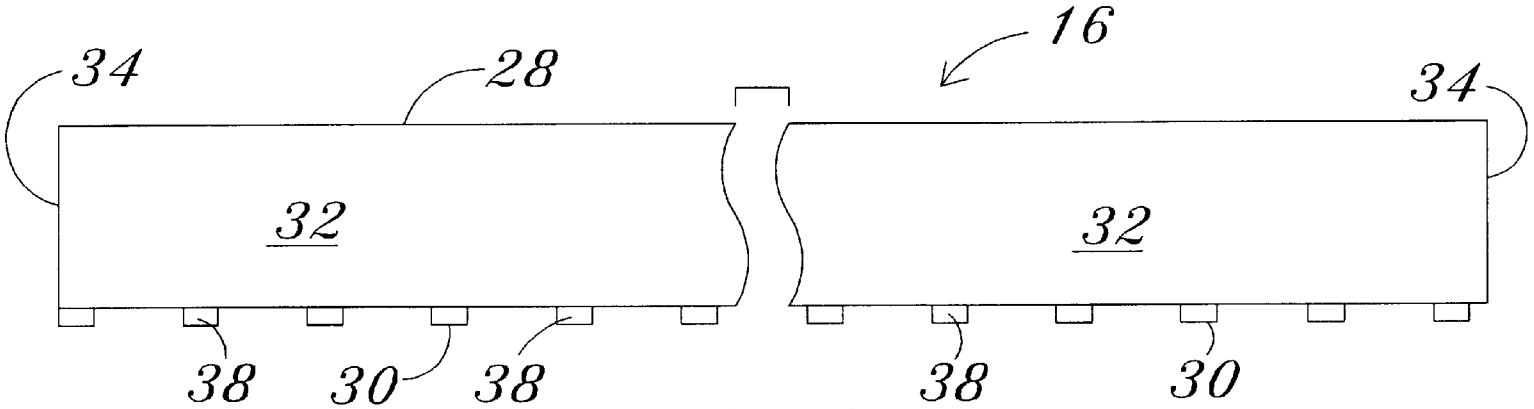
FIG. 2 is a side view of a wall unit of the preferred embodiment.

The best presently known mode for carrying out the invention is a modular precast construction block system and is set forth in FIG. 1 and designated by the general reference character 10. The preferred embodiment 10 includes a variety of different precast building blocks adapted to interconnect with each other in a variety of configurations allowing for a versatile range of building designs. The preferred embodiment 10 includes elements aimed at creating building walls and/or foundations. As shown in FIG. 1, the preferred embodiment 10 can be conceptualized as having two subsystems, a wall subsystem 12 and a foundation subsystem 14. In the preferred embodiment 10, the wall subsystem 12 includes the necessary components to create vertical structures. It is noted that the foundation subsystem 14 includes components to create a variety of foundation designs, and FIG. 1 illustrates only one type of foundation component. Additional aspects of the various foundation subsystem 14 components will be discussed at a later point herein.

The wall subsystem 12 of the preferred embodiment 10 is set forth in detail in FIGS. 1–8. Referring now to FIG. 1, the wall subsystem 12 of the preferred embodiment 10 is shown to include a number of wall units 16, a shear connecting bar assembly 18, a wall bar extension assembly 20, and a wall tensioning assembly 22. As illustrated in FIG. 1, the foundation subsystem 14 provides a number of upwardly projecting wall bars 24 that are received by the wall subsystem 12.

As illustrated in FIG. 1, the wall units 16 of the preferred embodiment 10 are designed to be stacked, one on top of each other, to create vertical, structural walls 26. The wall unit 16 of the preferred embodiment 10 is set forth in detail in FIGS. 2–4. As shown in the side elevational view of FIG. 2 and the end cross sectional view of FIG. 3, the wall units 16 have a generally rectangular solid shape that includes a wall unit top surface 28, a wall unit bottom surface 30, two wall unit side surfaces 32, and two wall unit end surfaces 34. As shown in the various figures, the wall unit side surfaces 32 are considerably longer than the wall unit end surfaces 34.

Figure 4:
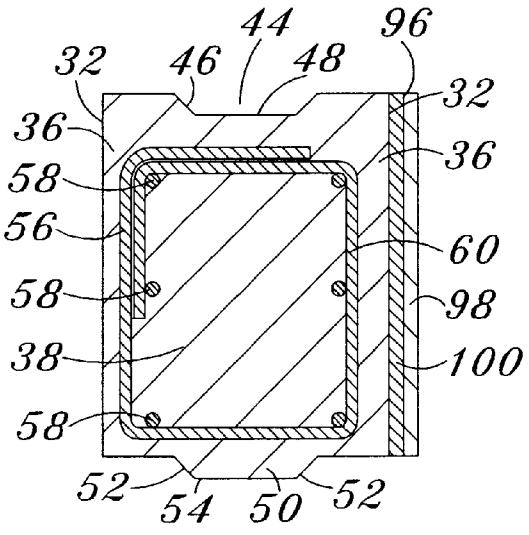
FIG. 4 is an end cross sectional view of a cavity wall of the preferred embodiment.
Figure 3:
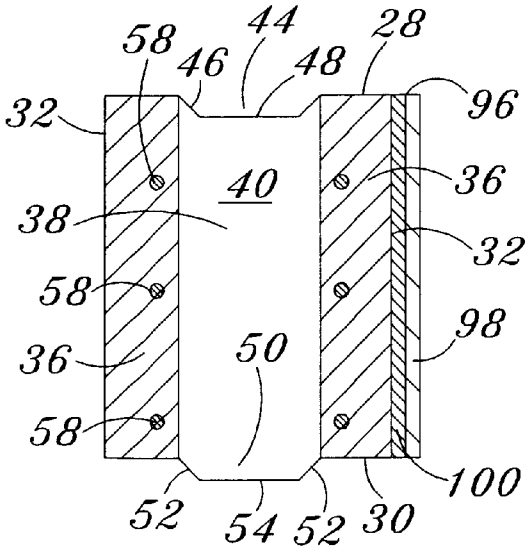
FIG. 3 is an end cross sectional view of a cavity in a wall unit of the preferred embodiment.

Each wall unit 16 is an integral molded structure having two rectangular, parallel, opposing wall unit side walls 36. The wall unit side walls 36 are joined by a number of cavity walls 38. As best illustrated in FIGS. 1 and 4, the cavity walls 38 are perpendicular to, and integral with, the wall unit side walls 36. The resulting structure creates a number of vertically extending cavities 40 within the wall unit 16. As best shown in FIG. 3, each cavity 40 extends all the way through the wall unit 16, opening into both the wall unit bottom surface 30 and the wall unit top surface 28. The molded design of the wall unit 16 provides structural integrity while at the same time, due to the cavities 40, reduces the weight of the wall unit 16. Reduced weight allows for rapid erection of vertical walls 26 structures with only relatively small lifting equipment. In the preferred embodiment 10 each wall unit 16 is precast at a discrete length but can be quickly and easily cut "on site" to fit any length requirement.

In the preferred embodiment 10, the wall units 16 are specifically shaped to aid in alignment and stacking. As shown in FIGS. 1, 3 and 4, the wall unit top surfaces 28 include a horizontally disposed alignment channel 42. The alignment channel 42 of the preferred embodiment 10 is formed by identical, downward indentations 44 in each of the cavity walls 38. As is best illustrated in FIGS. 3 and 4, each of the indentations 44 includes two sloped channel sides 46 and a channel bottom 48. Corresponding to the indentation 44 in each cavity wall 38 is a key portion 50 that extends below the wall unit side walls 36. The key portion 50 has a complementary shape to the indentation 44, having two sloped key sides 52 and a key bottom 54. As is best illustrated in FIG. 1, when stacked, the key portions 50 of one wall unit 16 fit within the indentations 44 of the wall unit 16 below. Because each wall unit 16 is precast from a precision mold in a controlled process, the tolerances of critical features in the wall unit 16 shape, such as the indentations 44 and the key portions 50, are maintained, which ensures repeatable, precision stacking of consecutive wall units 16.

Within each wall unit 16 of the preferred embodiment 10 is a reinforcement structure 56. The reinforcement structure 56 is illustrated in the partial cutaway view of FIG. 1 and the cross sectional views of FIGS. 3 and 4. Disposed within each wall unit side wall 36 are three parallel, horizontal tension cables 58. The tension cables 58 are pretensioned and cast in place when the wall units 16 are formed. The tension cables 58 place the entire wall unit 16 under compression when formed, which adds to the structural integrity of the wall unit 16 and reduces undesirable cracking and spalding. In addition to the tensioning cables 58, the reinforcement structure 56 of the preferred embodiment 10 also employs reinforcing stirrups 60. Each stirrup 60 is disposed within a cavity wall 38 and wraps around the tension cables 58. The tension cables 58 and stirrups 60 of the preferred embodiment 10 are constructed of steel. One skilled in the art would recognize that the number and type of tensioning cables 58 and stirrups 60 can vary according to desired wall unit 16 strength and material. It would also be recognized that while the preferred embodiment 10 includes the reinforcement structure 56, such a design is not critical to the invention 10. Wall units 16 without stirrups 60 may be employed where appropriate for the load and structural requirements of the application.

In the preferred embodiment 10 the wall units 16 are composed of fiber-reinforced mesh concrete mix. One skilled in the art would arrive at a number of variations in the material used to create the wall units 16 according to required strength and anticipated climate. The present inventors anticipate including, in addition to structural additives, color additives and/or water proofing additives. Of course, it is understood that waterproofing and coloring could be surface applied as well.

Figure 5:
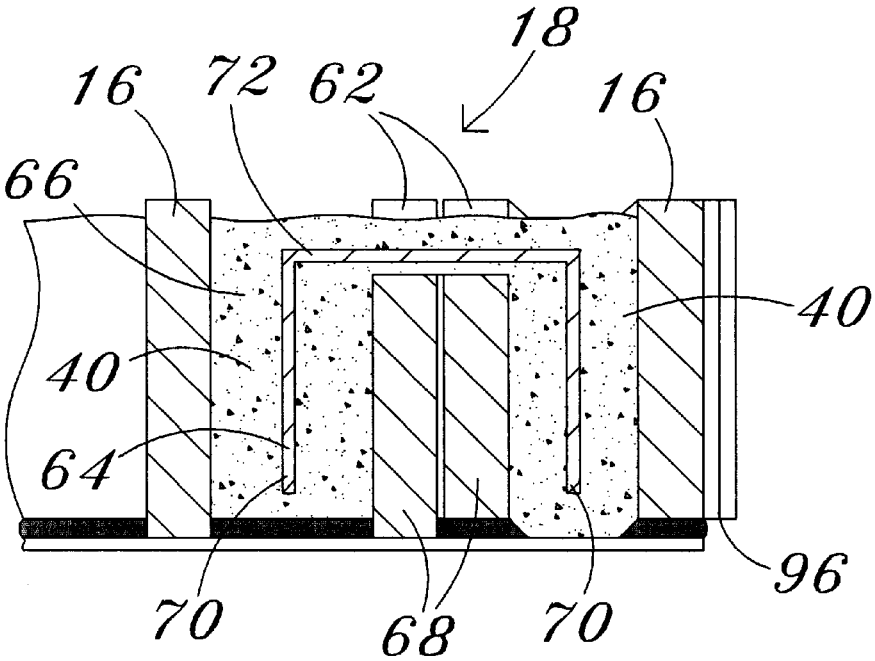
FIG. 5 is a side cross sectional view of two wall units joined by a shear connecting bar connection of the preferred embodiment.

As illustrated in FIG. 1, and best set forth in the cross sectional view of FIG. 5, horizontally adjacent wall units 16 of the preferred embodiment 10 are connected via the shear connecting bar assembly 18. The shear connecting bar assembly 18 includes two tie notches 62, a tie bar 64, and a cavity fill 66. As best shown in FIG. 5, the tie notches 62 are set within opposing joining walls 68. In the example illustrated in FIGS. 1 and 5, the joining walls 68 are the adjacent side wall 36 and cavity wall 38 of adjoining wall units 16. As the wall units 16 are abutted against one another, the tie notches 62 are aligned and the tie bar 64 disposed within the tie notches 62. As best shown in FIG. 5, the tie bar 64 has an inverted "U" shape with two vertical tie portions 70 joined by a horizontal tie portion 72. The tie bar 64 is arranged with the horizontal tie portion 72 set within the tie notches 62 and the vertical tie portions 70 extending downward into adjacent cavities 40. The adjacent cavities 40 are subsequently filled with the cavity fill 66 which completes the shear connecting bar assembly 18. In the preferred embodiment 10 it is intended for the tie notches 62 to be cut into the appropriate locations on adjoining wall units 16 at the construction site. It is understood however, that such a feature could be incorporated into the precast process to provide for wall units 16 formed with integral tie notches 62. While the views of FIGS. 1 and 5 illustrate the shear connecting bar assembly joining two perpendicular wall units 16 it is understood that the shear connecting bar assembly 18 may also be used for connecting wall units 16 arranged end-to-end or at angles other than ninety degrees. Along the same lines, the wall unit end surfaces 34 can be prefabricated at a variety of angles to add to versatility in structure design.

As mentioned previously, in the preferred embodiment 10, the foundation subsystem 14 provides a number of vertically disposed reinforcing wall bars 24. Referring once again to FIG. 1, it is shown that the wall units 16 are stacked onto foundation subsystem 14 with the wall bars 24 threaded through the cavities 40 within the wall units 16. While the incorporation of wall bars 24 provides for walls 26 of increased strength, it is understood that walls 26 can also be built that do not have wall bars 24 by simply stacking the wall units 16. When the wall units 16 are stacked structural integrity can be increased by filling selected cavities 40 with grout 75. It is understood that when the wall units 16 are vertically stacked, the cavities 40 of wall units 16 can be aligned, allowing the grout 75 to stretch the entire vertical length of the wall 26.

Figure 6:
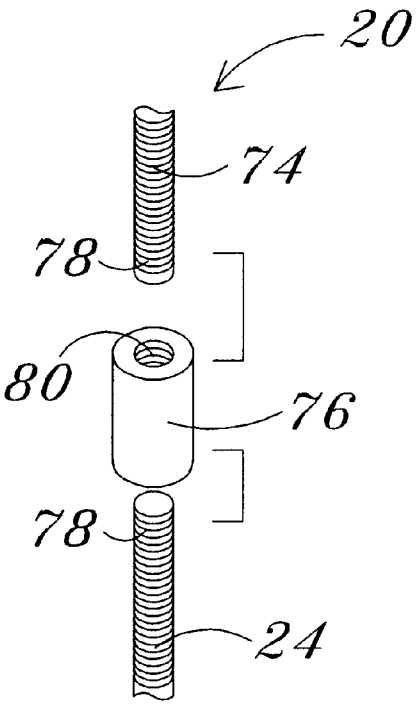
FIG. 6 is an exploded view of a wall bar and wall bar extension assembly of the preferred embodiment.

When wall bars 24 are employed, as shown in FIG. 1, the wall tensioning assembly 22 and/or wall bar extension assembly 20 can be provided to add structural strength, flexibility to design, and to improve the speed and ease in which buildings can be constructed. The wall bar extension assembly 20 and wall tensioning assembly 22 are set forth in detail in FIGS. 6–8. FIG. 6, which is a blown up portion of FIG. 1, sets forth an exploded view of the wall bar extension assembly 20 and an associated wall bar 24. The wall bar extension assembly 20 includes an extension bar 74 and a bar coupler 76. Both the wall bar 24 and the extension bar 74 are shown to be threaded, and each includes two bar ends 78. The bar coupler 76 includes a threaded coupler aperture 80 for receiving the bar ends 78 of both the wall bar 24 and the extension bar 74. The wall bar extension subassembly 20 is intended to, in essence, provide a vertical expansion to the wall bar 24. This aspect is advantageous in the event the wall units 16 must be stacked higher than the total vertical height of the wall bars 24. By using the wall bar extension assembly 20 extension bars 74 may be added to as great a height as is required for the anticipated structure.

Figure 7:
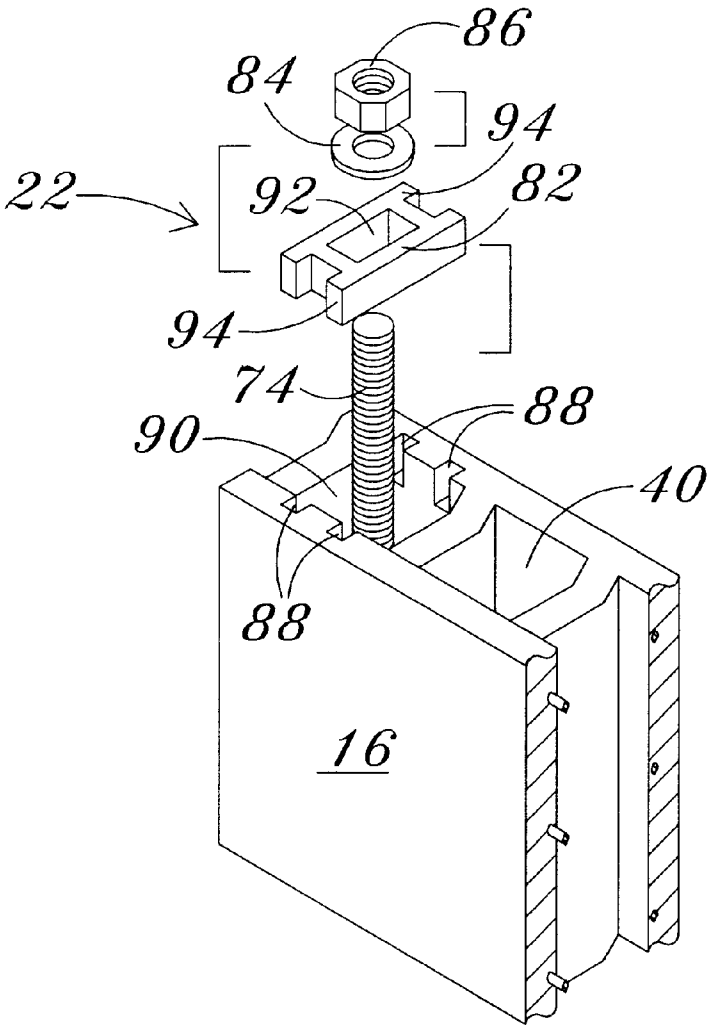
FIG. 7 is an exploded view of the wall tensioning assembly of the preferred embodiment.

In addition to adding structural integrity, the wall tensioning assembly 22 allows for the wall units 16 to be securely attached to the foundation subsystem 14 without additional bracing. As illustrated in the exploded view of FIG. 7, the wall tensioning assembly 72 of the preferred embodiment 10 includes an anchor plate 82, an anchor washer 84, and an anchor nut 86. The wall tensioning assembly also includes anchor notches 88 set within the wall unit 16. The wall tensioning assembly 22 as shown in FIG. 7 to be used in conjunction with an extension bar 74. It is understood that the design of the tensioning assembly 22 is equally applicable for use with a wall bar 24. The extension bar 74 is shown extending through an anchor cavity 90 within in the wall unit 16. The anchor cavity 90 is essentially identical to the other cavities 40, varying only in the inclusion of the anchor notches 88. The anchor plate 82 includes a bar receiving aperture 92, and two shaped anchoring ends 94. The anchoring ends 94 are designed to mate with the anchor notches 88 within the wall unit 16. The anchor plate 82 fits over the extension bar 74 with the extension bar 74 passing through the bar receiving aperture 92 and the anchor ends 94 mating with the anchor notches 88. The anchor washer 84 and anchor nut 86 are subsequently threaded onto the extension bar 74 and can be tightened to tension the wall unit 16 in a downward direction onto the foundation subsystem 14 or a wall unit 16 directly below. The bar receiving aperture 92 of the preferred embodiment 10 is slot shaped, which has been found by the inventors to facilitate the placement of the anchor plate 82 by creating a wider area for the extension bar 74 to fit within. The anchor notches 88 of the preferred embodiment 10 are precast into the wall units 16 at selected cavities 40 to create anchor cavities 90. While the preferred embodiment 10 sets forth an anchor plate 82 and corresponding anchor notches 88 of particular shape, it is understood that one skilled the art could arrive at a number of equivalent structures and the particular shape of the preferred embodiment 10 should not be considered limiting.

Figure 8:
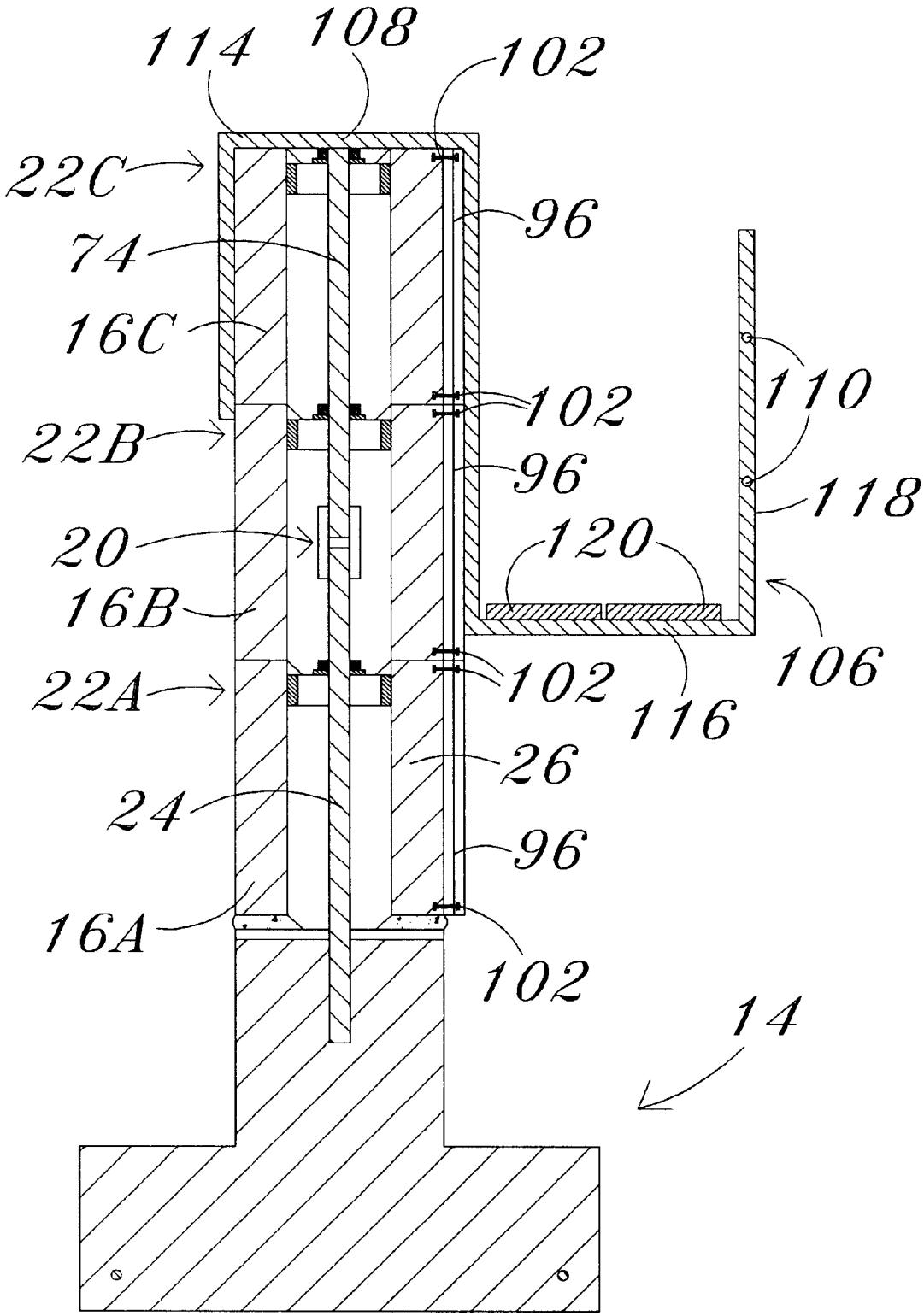
FIG. 8 is a side cross sectional view of a wall built with the preferred embodiment.

Referring now to the cross sectional view of FIG. 8, the wall bar extension assembly 20 and wall tensioning assembly 22 are shown in assembled form. FIG. 8 illustrates three wall units 16 vertically stacked, including a bottom wall unit 16A, a middle wall unit 16B and a top wall unit 16C. As set forth in the figure, the wall bar 24 extends upward, only halfway through the middle wall unit 16B. By employing the wall bar extension assembly 22, the extension rod 74 can be added to extend through the remaining portion of the middle wall unit 16B and the entire top wall unit 16C. While FIG. 8 illustrates a wall bar 24 of a particular vertical height, it is understood that the particular length of the wall bars 24 is not critical. Wall bars 24 and extension bars 74 can be cut, and extension bars 74 added until the desired vertical height is achieved.

FIG. 8 also shows three wall tensioning assemblies (22A, 22B and 22C), one for each wall unit (16A, 16B and 16C). The wall tensioning assemblies (16A, 16B and 16C) are illustrated in the assembled position. As mentioned previously, the tensioning effect provides structural integrity to the wall 26 and therefor, no additional bracing is required, as is necessary in prior art systems. While the example of FIG. 8 sets forth a wall tensioning assembly 22 for each wall unit 16, it is understood that fewer or greater numbers wall tensioning assemblies 22 can be employed per wall 26. As just one example, a wall 26 could employ only one wall tensioning assembly 22 in the very top most wall unit 16C.

As shown in FIGS. 1, 3–5 and 8, in the preferred embodiment 10 it is anticipated that selected wall units 16 can be produced with covering faces 96 attached thereto for decorative effects. As is best shown in FIGS. 3 and 4, each covering face 96 is a composite structure having a decorative layer 98 and an insulation layer 100. As illustrated in FIG. 8, the covering faces 96 are secured to the wall units 16 by a number of panel tie connectors 102. The decorative layer 98 allows any number of architectural finishes to be applied to the wall units 16 adding versatility to the aesthetic appearance of structures created with the preferred embodiment 10. The insulation layer 100 ensures that differences in thermal expansion between the decorative layer 98 and the insulation layer 100 will not result in stress fractures in the decorative layer 98. One skilled in the art would recognize that covering faces 96 do not have to be multilayered, and that side surfaces 32 of the wall units 16 themselves could be molded with various patterns and colors as desired. It is anticipated that covering faces 96 can also be formed with beveled edges to allow for wall units 16 joined at 90 degree or some other angular relationship.

One skilled in the art would recognize that the wall units 16 could be precast with any variety of prior art hardware attachment designs for providing an attachment point for lifting cranes. Just one such example would be an anchor and recess plug combination.

Figure 9:
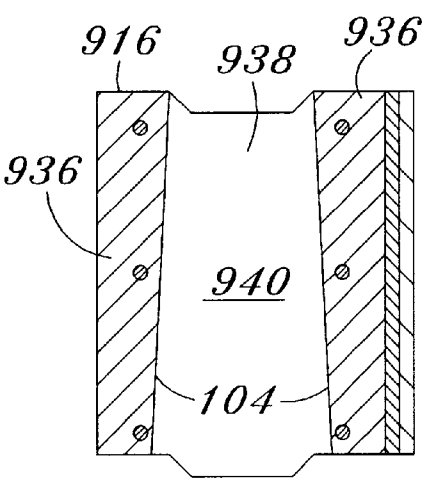
FIG. 9 is an end cross sectional view of an alternate wall unit.

FIG. 9 illustrates an alternate wall unit design, designated as 916. The alternate wall unit is very similar to the wall unit 16 of the preferred embodiment 10, and to that extent those elements of the alternate wall unit 916 which are identical to those appearing in the preferred embodiment 10 will be referred to by a reference number incorporating the original reference number with an initial digit "9". FIG. 9 presents a side cross sectional view of the alternate wall unit 916. Like that of the preferred embodiment 10, the alternate wall unit 916 includes two wall unit side walls 936 joined by integral, perpendicular wall unit cavity walls 938, creating a number of cavities 940 within the wall unit 916. The alternate wall unit 916 departs from the preferred embodiment 10 in the shape of the wall unit side walls 936 which creates cavities 940 having non-vertical walls. As illustrated in FIG. 9, the side cross sectional aspect of the wall unit side walls 936 of the alternate wall unit 916 are not rectangular, as in that of the preferred embodiment 10, and instead includes opposed, negatively sloped cavity faces 104. The inventors have found this arrangement presents a unique advantage in hoisting procedures for the wall units 916. The negative slope of the cavity faces 104 allows for an expanding hoisting member to be inserted into one or more of the cavities 940, expand and engage the sloped cavity faces 104, allowing the wall units 916 to be hoisted thereby. The hoisting advantages of the alternate wall unit 916 eliminates the needs for complex rigging, or cast-in-place hoisting attachments.

Referring once again to the preferred embodiment 10 set forth in FIG. 8, it is shown that the wall subsystem 12 of the preferred embodiment 10 includes a scaffold assembly 106 that is particularly adapted to work with the wall units 16 of the preferred embodiment 10. As illustrated in cross section in FIG. 8, the scaffold assembly 106 includes a number of frame members 108 and safety wire 110. Each frame member 108 is a rigid, integral structure that includes an overhang portion 114, a support portion 116, and a railing portion 118. The overhang portion 114 is shaped to curve over and snugly engage the top most wall unit 16C of the wall 26 created with the precast construction block system of the present invention 10. The support portion 116 extends away from the frame member 108, perpendicularly to the wall 26. As shown in FIG. 8, the railing portion 118 extends upward from the support portion 116, opposite from the overhang portion 114. In the preferred embodiment 10, the frame members 108 are disposed in a row, at set intervals, along the entire wall 26. Because the row of support portions 116 do not, in themselves, provide adequate footing, a number of planks 120 are overlaid on the row of support portions 116, creating a solid flooring to support crew members. A protective enclosure is provided by the safety wire 110 strung between adjacent railing portions 118. The unique design of the scaffold assembly 106 of the preferred embodiment 10, eliminates the need for erecting conventional scaffolding, which is extremely time consuming.

Referring once again to FIG. 1, it is recalled that in the preferred embodiment 10, the wall subsystem 12 rests upon, and interconnects with the foundation subsystem 14. It is understood that it is not necessary for the wall subsystem 12 to be used only with the foundation subsystem 14 provided by the preferred embodiment 10. Any foundation providing level, load bearing elements can be used, including cast-in-place foundations. If desired, cast in place foundations can be formed with wall bars 24. In the preferred embodiment 10, the spaces between the wall units 16 and the foundation subsystem 14 are filled by a bed of structural shim and mortar. It is noted that structural shim and mortar could also be used between vertically stacked wall units 16. As this method is well known in the art it will not be set forth in detail herein.

Figure 10:
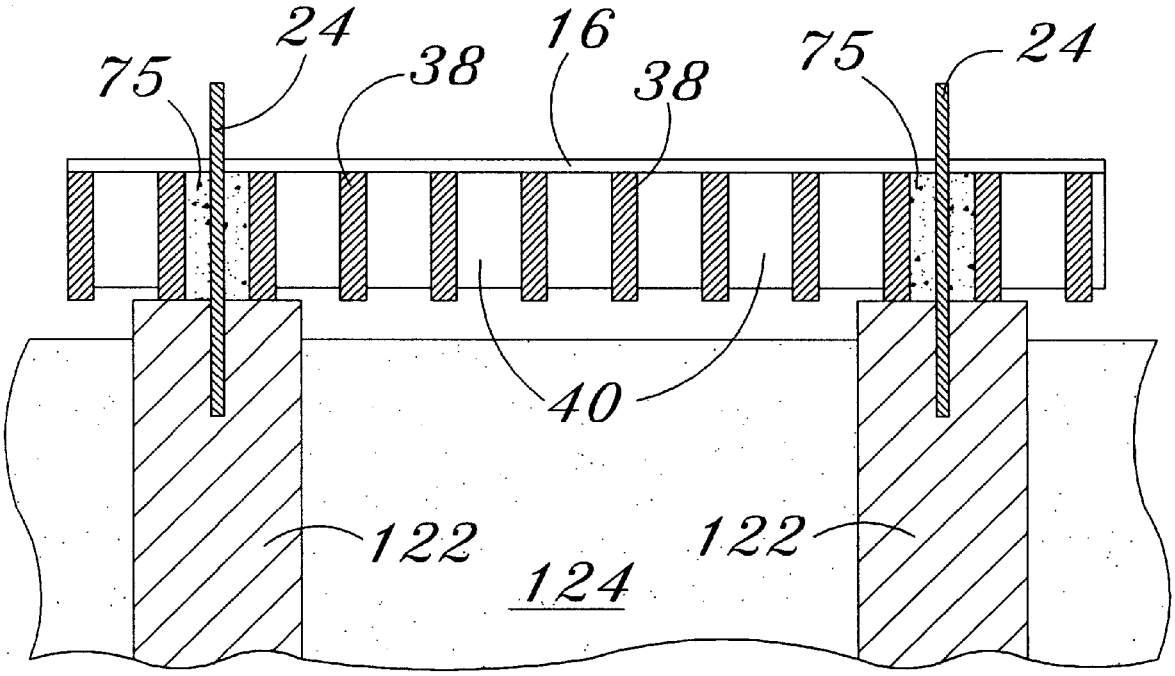
FIG. 10 is a side cross sectional view of a grade beam application of the wall unit of the preferred embodiment.

Referring to FIG. 10, a foundation application of the wall subsystem 12 is set forth. FIG. 10 illustrates the use of a wall unit 16 as a foundation grade beam. As set forth in the figure, the wall unit 16 is situated upon two cast-in-place foundation piers 122 formed within the ground 124. Each of the cast-in-place foundation piers 122 was formed with a wall bar 24 in place. The wall bar 24 is received by the cavities 40 within the wall unit 16. The cavity 40 of the wall unit 16 that receives the wall bar 24 is filled with grout 75. The wall unit 16 can then be the load bearing element for more wall units 16, or if desired, support walls created from conventional methods and components. While the wall unit 16 of FIG. 10 is secured to the cast-in-place foundation piers 122 by grout 75 and wall bars 24, the wall tensioning assembly 22 could also be used in this application. Thus, although the present invention 10 can be conceptualized as including a wall subsystem 12 and a foundation subsystem 14, components of the wall subsystem 12 can be used to in the creation of foundations.

As set forth in FIG. 1, the modular precast construction block system of the present invention, in the preferred embodiment 10, includes a foundation subsystem 14 in addition to the wall subsystem 12. Like the wall subsystem 12, the foundation subsystem 14 provides a wide variety of precast foundation members that are used according to the type of foundation desired. The various components of the foundation subsystem 14 of the preferred embodiment 10, are set forth in detail in FIGS. 11–15 and are shown to include "T" footing members 126, pier members 128, grade beam members 130, and column members 132.

Figure 11:
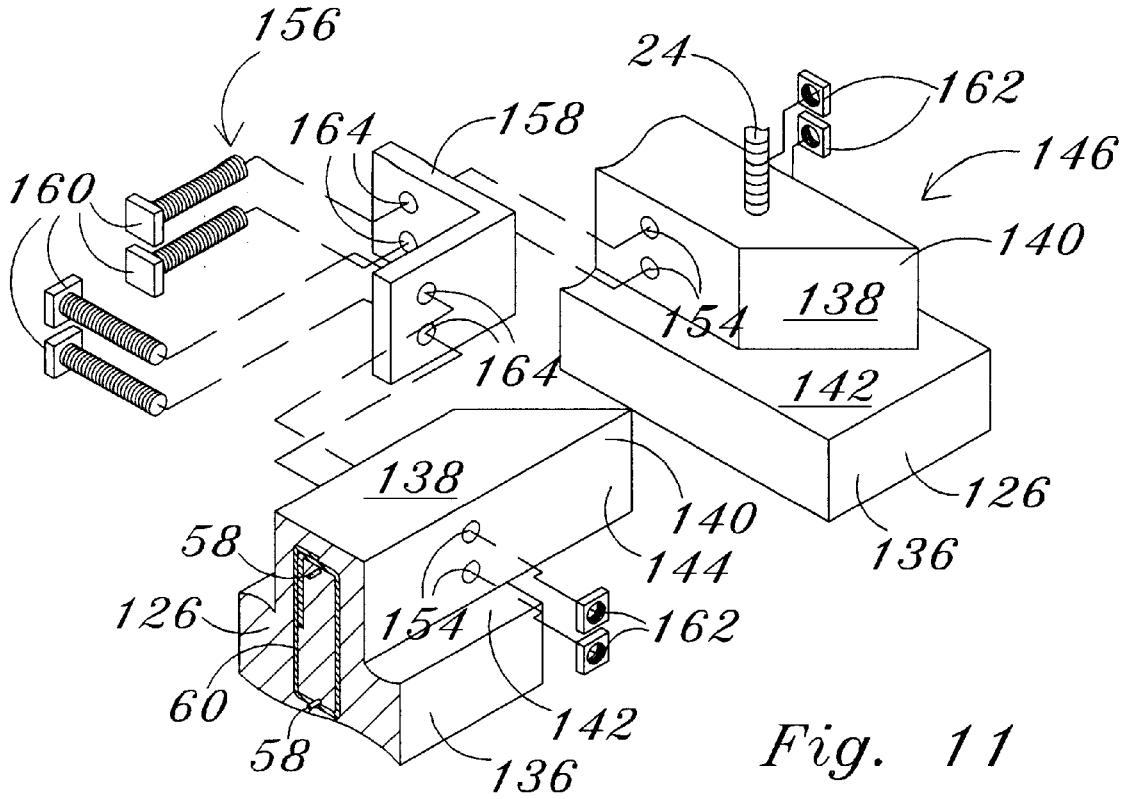
FIG. 11 is a partially cut away isometric view of the "T" footing members of the preferred embodiment.
Figure 12C:
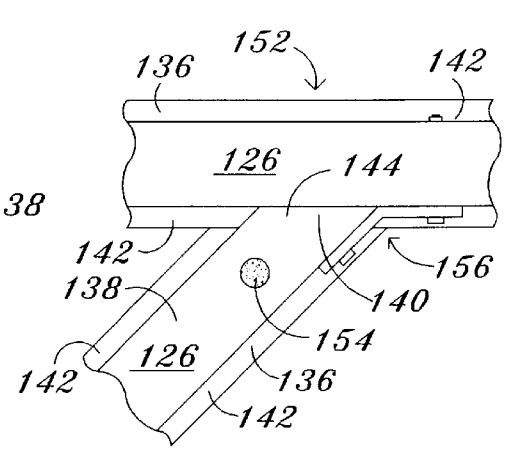
FIGS. 12A–12C are top plan views of three examples of "T" footing member pairs of the preferred embodiment.
Figure 12B:
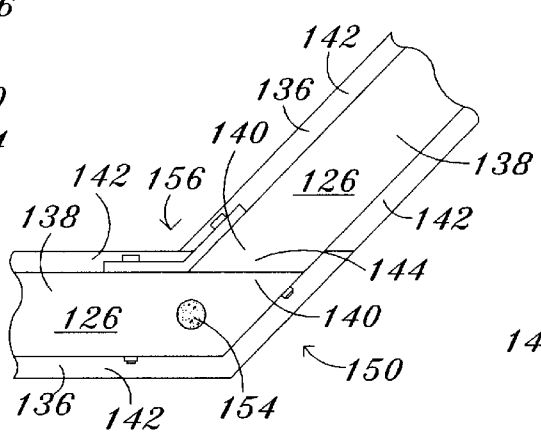
Figure 12A:
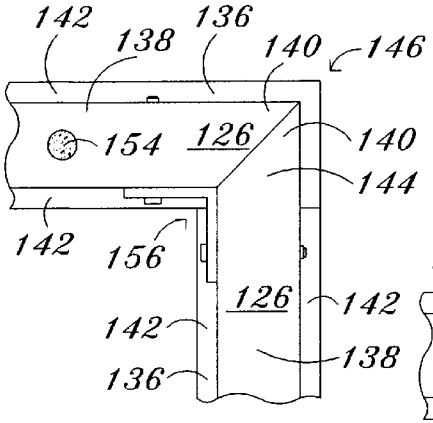

FIG. 1 illustrates a continuous spread footing foundation design 134 composed of the "T" footing members 126 which are best set forth in FIGS. 11 and 12A–12C. The "T" footing members 126 are precast, integral units each having a T foot base portion 136 and an upward extending T foot anchor portion 138. Each "T" footing member 126 terminates in two shaped T foot ends 140. The T foot base portion 136 is wider than the T foot anchor portion 138 giving the "T" footing members 126 an inverted T end cross sectional aspect. The shape of the "T" footing member creates opposing T foot ledges 142. The T foot ends 142 are best described by referring to FIG. 12. As shown in the figure the "T" footing members 126 are precast with complementary shaped T foot ends 140 where one "T" footing member 126 would include a foot end overlap 144 that matches the T foot ledge 142 of a corresponding "T" footing member 126. In addition, the T foot ends 140 can be angled. FIGS. 1, 11 12A each illustrate a 90-degree-corner footing pair 146. shaped to create a ninety degree corner in the continuous spread footing foundation design 134. One skilled in the art would recognize that this basic design can include any number of angled pairs. Just a few of the possible examples are set forth in the various figures. FIG. 1, in addition to illustrating a 90-degree-corner footing pair 146, also illustrates a 90-degree-tee-joint footing pair 148. Two additional variations are set forth in FIGS. 12B and 12C, which illustrate a 135-degree-corner footing pair 150 and a 45-degree-tee-joint footing pair 152, respectively. In the preferred embodiment 10, the "T" footing members 126 are precast in left and right 45 degree, and 90 degree shaped T foot ends 140. As is best set forth in FIG. 11, the "T" footing members 126 of the preferred embodiment 10 also include cast in place wall bars 24 and connecting apertures 154 which extend through the T foot anchor portion 138.

The internal design of the "T" footing members is best described by referring to the cutaway view of FIG. 11. Like the wall units 16 of the wall subsystem 12, the "T" footing members 126 of the preferred embodiment 10, include tensions cables 58 and stirrups 60 to provide additional structural integrity to the "T" footing members 126. As in the case of the wall units 16, the tension cables 58 and stirrups 60 can be omitted from the precasting process if desired.

As illustrated in FIGS. 1, 11 and 12, "T" footing members 126 of the preferred embodiment 10, are joined by a connecting assembly 156. The connecting assembly 156 is best described in conjunction with FIG. 11. The connecting assembly 156 includes connecting plates 158, connecting bolts 160, and connecting nuts 162. Each connecting plate 158 is pre-shaped to match the angle of the "T" footing members 126 to be joined. Each connecting plate 158 includes a number of bolt apertures 164 that are formed so as to be aligned with the connecting apertures 154 of the "T" footing members. The connecting bolts 160 are threaded through the bolt apertures 164 and corresponding connecting apertures 154. The connecting bolts 160 secure the connecting plate 158 to the "T" footing members 126, and consequently secure the "T" footing members 126 together. As would be clear to one skilled in the art, the connector apertures 154 and connector plates 158 can be shaped for "T" footing member 126 connections of various angles. Just three such examples are illustrated in FIGS. 12A–12C. One skilled in the art would recognize that the connecting assembly could include threaded studs that are cast within the "T" footing members and thus eliminate the need for connector apertures 154 and connector bolts 160. It is understood that while used only for the "T" footing members 126 in the preferred embodiment 10, the connecting assembly 156 could also be used to join other precast components of the present invention 10, including the wall units 16 of the wall subsystem 12.

Figure 13:
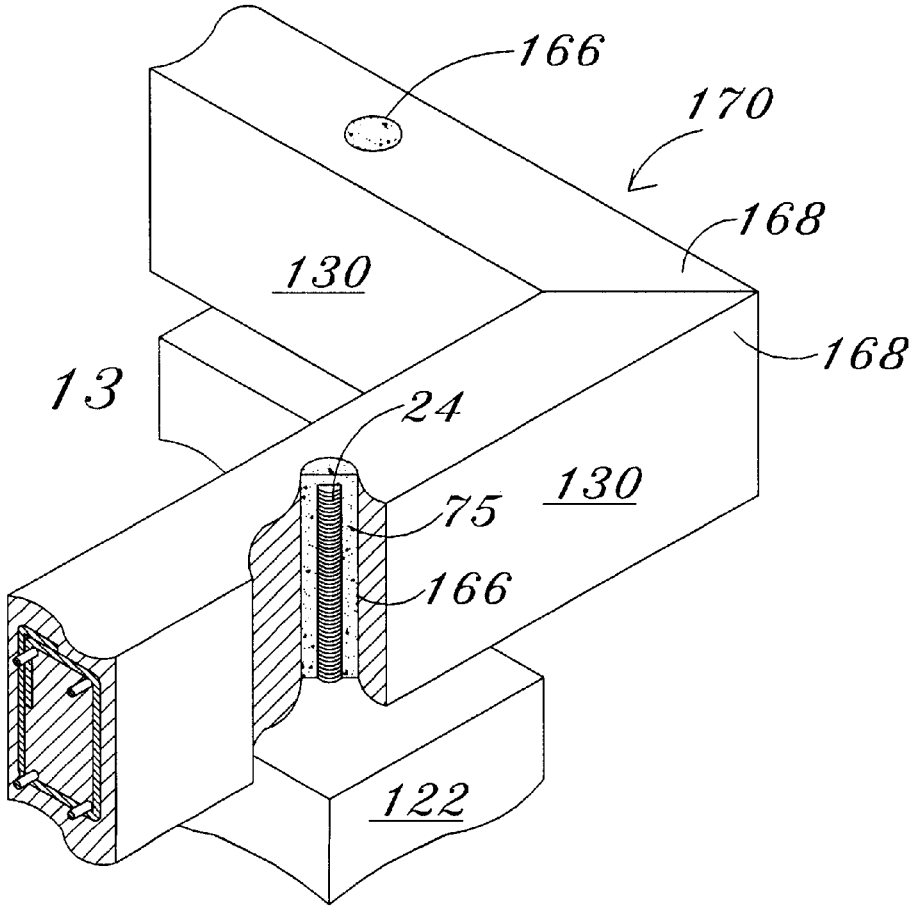
FIG. 13 is a partially cut away isometric view of the grade beam members of the preferred embodiment.
Figure 14C:
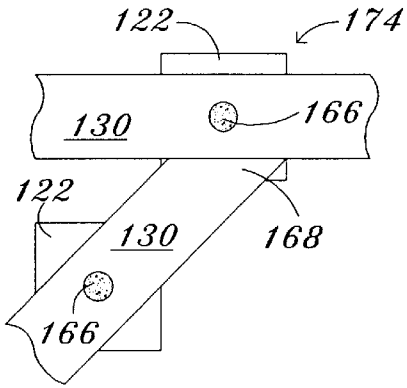
FIGS. 14A–14C are top plan views of three examples of grade beam member pairs of the preferred embodiment.
Figure 14B:
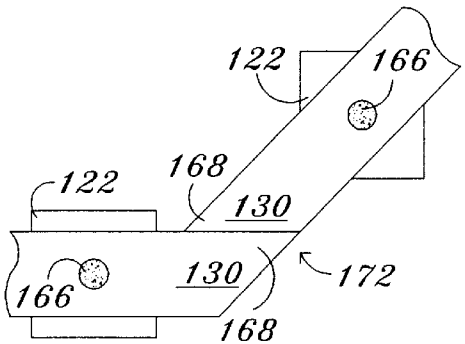
Figure 14A:
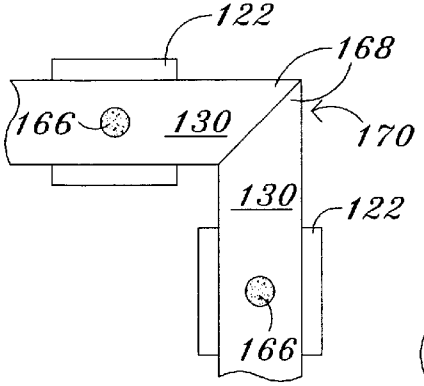

The grade beam members 130 of the foundation subsystem 14 are illustrated in FIGS. 13 and 14. The grade beam members 130 are adapted to be used in combination with cast-in-place-foundation piers 122, similar to the foundation design employing wall units 16 set forth in FIG. 10. As illustrated in FIG. 13, the grade beam members 130 are generally rectangular solid structures having a number of vertical beam rod apertures 166 therethrough. The vertical beam rod apertures 166 serve as receptacles for upward extending wall bars 24 that are precast into the cast-in-place foundation piers 122. The beam rod apertures 166 are filled with grout 75 to secure the grade beam members 130 to the cast in place foundation piers 122. Very similar to the "T" footing members 126, the grade beam members 130 each have two grade beam ends 168 which can be angled to create angled beam pairs. The views of FIGS. 13 and 14A illustrate a 90-degree-corner beam pair 170. A 135-degree-corner beam pair 172 is illustrated in the top plan view of FIG. 14B, and a 45-degree-tee beam pair 174 is illustrated in FIG. 14C. It is noted that, like the "T" footing members 126, any variety of angled connections can be formed. It is further noted that like the wall units 16 and "T" footing members 126, the grade beam members 130 can be formed with horizontal connector apertures 154 and be joined by a connector assembly 156.

Figure 15:
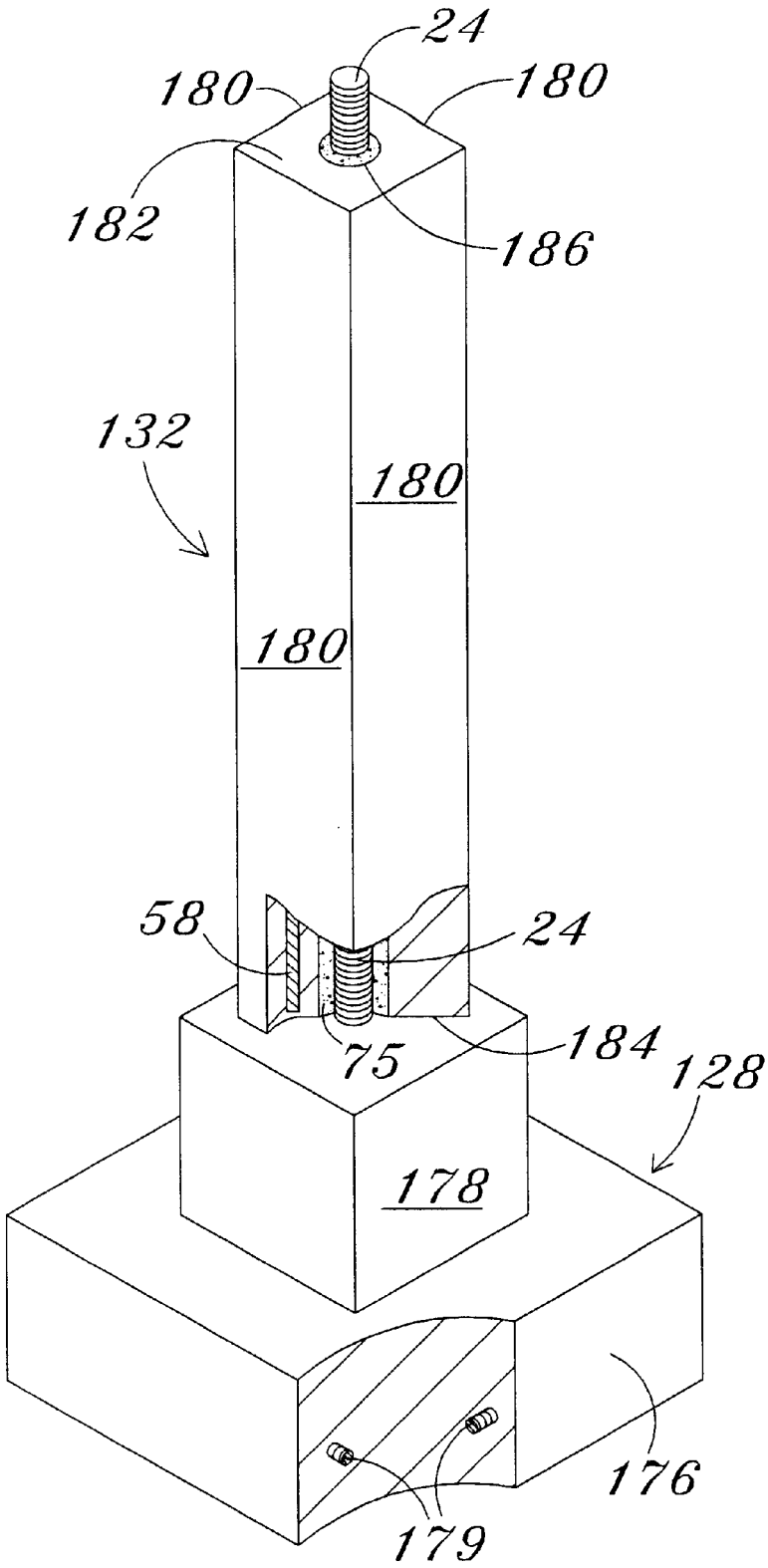
FIG. 15 is a partially cut away isometric view of a pier member and a column member of the preferred embodiment.

FIG. 15 illustrates in detail, the pier member 128 and the column member 132 of the foundation subsystem 14. In the partially cut away isometric view, the column member 132 is depicted as attached to, and extending upward from, the pier member 128. It is understood that both the pier member 128 and the column member 132 can be used with the other members of the foundation subsystem 14, as well as with conventional foundation designs. The combination of pier member 129 and column member 132 in FIG. 15 is intended for illustrative purposes only. The pier member 128 of the preferred embodiment 10 is an integral, precast structure that includes a pier base portion 176 and a generally cubic pier anchor portion 178. The pier anchor portion 178 extends upward from, and is smaller than, the pier base portion 176. As shown in the cut away view, the pier member 128 of the preferred embodiment is reinforced with a pier reinforcement bar 179 which is cast in place for added strength. Also cast in place upon formation, is a vertically disposed wall bar 24 serving the same function as the wall bars 24 of the other precast foundation members.

The column member 132 of the preferred embodiment 10, is a vertically disposed rectangular solid structure, having four column sides 180 a column top 182 and a column bottom 184. Running vertically through the column member 132 is a column rod aperture 186 that opens into the column top 182 and column bottom 184. The column rod aperture 186 is adapted to receive a reinforcement bar (the wall bar 24 of the pier member 128 in FIG. 15) and subsequently be filled with grout 75. Precast within the column member 132 are vertically disposed prestressed tension cables 58. The column member 132 provides an elevated load bearing point for structure designs, and is particularly adapted for structures built on steep slopes. While the column member 132 has a rectangular solid shape, it is understood that cylindrical or other shaped column members 132 can be precast and utilized in the preferred embodiment 10.

Various modifications may be made to the invention without altering its value or scope. All of the above are only some of the examples of available embodiments of the present invention. Those skilled in the art will readily observe that numerous other modifications and alterations may be made without departing from the spirit and scope of the invention. Accordingly, the above disclosure is not intended as limiting and the appended claims are to be interpreted as encompassing the entire scope of the invention.

INDUSTRIAL APPLICABILITY

The modular precast construction block system 10 of the present invention is intended to be widely used in the construction industry as a quick, precise, cost effective alternative to cast-in-place structural elements. The precast wall units 16, "T" footing members 126, pier members 128, grade beam members 130, and column members 132 are each interchangeable and compatible with standard wall, and/or foundation designs.

The wall units 16 of the preferred embodiment 10 are intended to be produced in standard sixty foot lengths, and cut on site to smaller lengths if necessary. The wall units 16 are also intended to be produced in standard heights of 18", 24" and 30". Typical widths will correspond to a standard cast in place wall thickness of 8", 10" or 12". The intended sizes of the wall units are particularly advantageous in that they are long enough to create large structures, yet do not require an on site slab necessary for large cast on-site systems. The reduced weight of the components and relatively small lifting equipment required for deployment result in a system that does not require a minimum site size.

The wall subsystem 12 or the foundation subsystem 14 can be employed together, or separately. The wall subsystem 12 is intended to be used for a number of applications, including foundation designs. The inventors consider the wall subsystem 12 particularly adaptable in the construction of underground parking structures, basements, retaining walls, building walls, sound walls, and fences. Just a few of the foundation applications of the wall subsystem 12 are stems/spread footing foundation designs, and as grade beams in pier/grade beams foundation designs. When the wall units 16 are disposed sideways, that is with the wall unit side surfaces 32 facing upward and downward, the wall subsystem 12 can also be used to create a floor. The wall units 16 are also adaptable for use in individual applications, as a span beam and or wall opening beam.

In the preferred embodiment 10 of the present invention he precast members of the foundation subsystem 14 and wall subsystem 12 can be stockpiled for immediate use or produced parallel with the construction job so as to provide a "just-in-time" production method. When the various precast members are stockpiled, the preferred embodiment 10 can be immediately ready for any construction applications requiring immediate response, dispensing with the coordination between materials suppliers and specialized crew members that are required for conventional construction methods. When stockpiled there is no need to create new concrete molds, reducing the initial capital required for any particular job. When used in a "just-in-time" supply method, the preferred embodiment 10 is a cost effective, extremely efficient construction system 10 that eliminates waste caused by surplus production.

The present invention is intended to be used during all times of the year. Because no concrete pouring is required, inclement weather does not have an impact on the modular precast construction block system 10. In addition, unlike cast-in-place methods, the preferred embodiment 10 is a very "clean" system, as no poured concrete is required. The present invention also completely eliminates the need to create forms on site. The elimination of the custom materials and labor necessary for on site forms provides additional cost savings. The modular precast construction block system of the present invention 10 may be utilized in any application where cast in place walls or other structures are used. It provides for decreased construction time and requires curing only when grout 75 or other cavity fill 66 is required.

The inherent stability of structures created with the present invention eliminates the need for a welded superstructure. Thus, as buildings are erected with the present system 10 the specialized labor force and specialized inspection required for other construction systems can be avoided with the present invention.

Since the modular precast construction block system 10 of the present invention may be readily constructed and may be adapted for a wide range of construction applications, it is expected that it will be acceptable in the industry as an effective alternative present methods. For these and other reasons, it is expected that the utility and industrial applicability of the invention will be both significant in scope and long-lasting in duration.

What is claimed is:

1. A building system, comprising:

a plurality of precast wall units of a rectangular solid shape including a length, a width, and a height, the length being substantially greater than the height and width, each of said wall units including a vertically disposed first side wall, a vertically disposed second side wall, and a plurality of vertically disposed cavity walls, the side walls extending the length of each of said wall units and the cavity walls being integral with and joining the side walls, each side wall including at least one horizontally disposed pretensioned reinforcement wire to impart a prestressed character to each of said wall units, the cavity walls and the side walls defining a plurality of wall cavities, said precast wall units being vertically stacked to create a vertical wall.

2. The building system of claim 1 wherein:

selected wall cavities are filled with grout for added structural integrity.

3. The building system of claim 1 further including:

at least one stirrup bar disposed within each said precast wall unit, the stirrup bar disposed perpendicularly to the pretensioned reinforcement wire, each one of the stirrup bars being a rectangular wrapped structure passing through one of the cavity walls around the pretensioned reinforcement wire.

4. The building system of claim 1 further including:

a plurality of vertically disposed reinforcement rods extending through the wall cavities of the stacked precast wall units.

5. The building system of claim 4 wherein:

at least one of the reinforced rods includes a plurality of vertically disposed, threaded structural rods connected by a threaded coupling.

6. The building system of claim 4 further including:

an anchor system including a plurality of shaped notches within at least one wall cavity of at least one precast wall unit, at least one horizontally disposed anchor plate, and tensioning means, the anchor plate being shaped to fit within the shaped notches and including a rod channel for receiving one of the reinforcement rods, the tensioning means forcing the anchor plate downward into the shaped notches.

7. The building system of claim 4 further wherein:

at least one of the reinforcement rods extends upward from a foundation member.

8. The building system of claim 1 wherein:

at least one pair of said precast wall units are located in horizontally adjacent fashion and are joined by shear connecting bar means.

9. The building system of claim 8 wherein:

the shear connecting bar means includes a tie channel set within adjacent precast wall units and a shear tie, the shear tie having an inverted u-shape with two downward extending legs joined by a bridge portion, the bridge portion being disposed within the tie channel.

10. The building system of claim 1 further including:

a scaffolding subassembly including a plurality of rigid scaffold members, each said scaffold member having an overhang portion for wrapping over the vertical wall and a crew portion connected to the overhang portion, the crew portion including a horizontal floor portion.

11. A vertical wall building block system, comprising:

a plurality of precast block members, each said block member having a length and a width, a top surface, a bottom surface, a first side surface, a second side surface, a first end surface and a second end surface, and a plurality of vertical cavities extending through each said block member between the side surfaces, the length being substantially greater than the width, each vertical cavity opening into the top surface and the bottom surface, each said block member including a plurality of prestressed cables precast therein, the prestressed cables disposed parallel to the side surfaces, said block members being arranged with the bottom surface of a first said block member opposing the top surface of a second said block member, said block members further being arranged with the first and second end surfaces of the first said block member in planar vertical alignment with the first and second end surfaces of the second said block member.

12. The vertical wall building block system of claim 11 wherein:

the top surface of each said block member has a horizontally disposed downwardly extending trough therein and the bottom surface has a downwardly projecting key portion, the trough of one said block member being shaped to receive the key portion of another said block member thereon.

13. The vertical wall building block system of claim 12 further including:

cavity walls separating adjacent ones of the vertical cavities, wherein the trough is defined by identical, downwardly extending notches in the cavity walls and the key portion is formed by downward extensions of the cavity walls.

14. The vertical wall building block system of claim 11 wherein:

at least one of the side surfaces includes a decorative design thereon.

15. The vertical wall building block system of claim 14 wherein:

the decorative design is formed by a covering face, the covering face including a decorative facing and an insulation layer attached to at least one of the side surfaces of said block member by a plurality of ties, the insulation layer being intermediate the decorative facing and the side surface.

16. A construction system, comprising:

a vertically extending reinforcing bar, said reinforcing bar having an anchored lower end and a bar width; and a plurality of precast wall sections, each said wall section having a length, a width, a top surface, a bottom surface, and at least one prestressed member present therein, the length being substantially greater than the width and the prestressed member extending the length of each said wall section, each said wall section further having at least one vertically disposed aperture for receiving said reinforcing bar therethrough, the aperture being substantially larger than the bar width; wherein said wall sections are stackably assembled on said reinforcing bar with said wall sections being arranged with the bottom surface of a first said wall section opposing the top surface of a second said wall section.

17. The construction system of claim 16 further including:

a wall tensioning subassembly having at least one plate member and a tightening member, the plate member being adapted to engage the top surface of one of said wall section, the tightening member engaging the reinforcing bar and applying downward force on the plate member.

18. The construction system of claim 16 wherein:

each said wall section has a top surface with a top topology and a bottom surface with a bottom topology, the bottom topology being complementary to the top topology such that said wall sections are caused to be vertically aligned.

* * * * *